United States Patent [19]

Solignac

[11] Patent Number: 4,892,133

[45] Date of Patent: Jan. 9, 1989

[54] PROCESS FOR MONITORING AND REGULATING THE LUBRICATION OF THE WORKING FACE OF THE ROTARY ROLLS OF A CONTINUOUS STRIP CASTING MACHINE

[75] Inventor: Philippe Solignac, Saint Egreve, France

[73] Assignee: Cegedure Societe de Transformation de l'Aluminum Pechiney, Paris, France

[21] Appl. No.: 245,636

[22] Filed: Sep. 16, 1988

[30] Foreign Application Priority Data

Oct. 14, 1987 [FR] France ..... 87 14491

[51] Int. Cl.[4] ..... B22D 11/07

[52] U.S. Cl. ..... 164/452; 164/480; 164/472

[58] Field of Search ..... 164/4.1, 452, 454, 150, 164/154, 413, 450, 428, 472, 268

[56] References Cited

U.S. PATENT DOCUMENTS 4,497,360 2/1985 Bercovici ..... 164/454
4,501,315 2/1985 Bercovici ..... 164/454

FOREIGN PATENT DOCUMENTS 2463397 9/1979 France .
56-11172 2/1981 Japan .
58-135758 8/1983 Japan .
59-147762 8/1984 Japan .

*Primary Examiner*—Kuang Y. Lin
*Attorney, Agent, or Firm*—Dennison, Meserole, Pollack & Scheiner

[57] ABSTRACT

The invention relates to a process for regulating the lubrication of the working face of the rolls of a continuous strip casting machine. The process is characterized in that, in order to operate the machine at the highest possible speed while avoiding excesses of lubricant or sticking phenomena, at least one beam of coherent light is directed on to the working face of each of the rolls or on the each of the faces of the strip or on to the face of a roll and the face of the strip opposite to said roll, the values of the mean strength and/or the frequency of the variations in the beam reflected by said faces are measured, said measured values are compared to values in reference intervals, and the speed of rotation of the rolls and/or the lubricant flow rate is adjusted in dependence on the location of said values with respect to said intervals. It finds application in all machines for casting material between rolls in which there is a wish to achieve a maximum level of productivity.

12 Claims, 1 Drawing Sheet

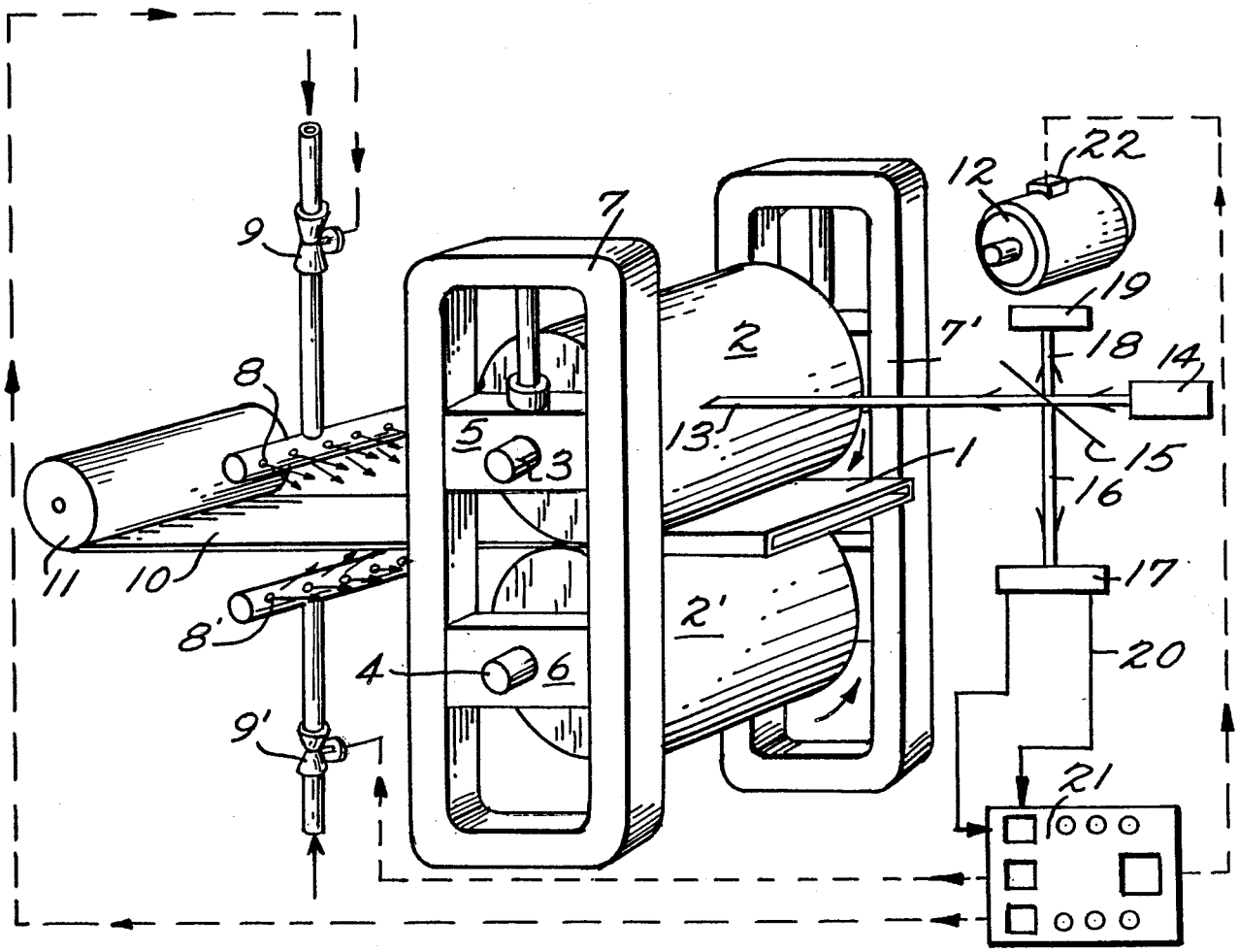
22
12
19
18
14
7'
15
16
1
17
20
21
2
13
2'
7
5
3
6
4
9
8
8'
9'
10
11

PROCESS FOR MONITORING AND REGULATING THE LUBRICATION OF THE WORKING FACE OF THE ROTARY ROLLS OF A CONTINUOUS STRIP CASTING MACHINE

The present invention relates to a process for monitoring and regulating the lubrication of the working face of the rolls of a continuous strip casting machine.

The man skilled in the foundry art and in particular in respect of non-ferrous metals is aware that it is possible to put metal in the molten state directly into the form of a strip which is a few millimetres* in thickness and several metres in width by means of a machine for casting same between rolls.

A machine of that type is described for example in French Pat. No. 1 198 006. It generally comprises two horizontal rolls whose side walls or working faces which are cooled from the interior rotate in opposite directions in mutually facing relationship at a distance from each other corresponding to the thickness of the strip to be cast. The molten metal is introduced between the continuously lubricated working faces where, by cooling upon contact therewith, it solidifies and is then roller, In such machines the rotary movement may be produced either by rotating one of the rolls by means of a motor, with the other roll being entrained by the movement of the strip therethrough or by means of a mechanical gear assembly, or by means of two motors which separately drive each of the rolls.

Like most operators, all users of those machines are concerned with being able to manufacture products of high quality at the best price. In the present case, among other conditions, that involves the need to cause the machines to rotate at the highest possible speed, that is to say the highest speed which is compatible with certain operating limits, beyond which the manufactured product would suffer from incurable defects such as portions of casting material which break out of the casting, for example due to inadequate cooling of the strip.

In regard to achieving the highest possible speed referred to above, one of the major obstacles encountered by users in seeking to achieve that maximum level of productivity is 'sticking', that is to say sudden adhesion of the strip to a greater or smaller part of the working face of at least one of the rolls. Indeed, that phenomenon makes it necessary either to reduce the speed of the machine or even to stop it, and in any case it results in a part of the cast strip being rejected. For that reason efforts are made by users to try to prevent that phenomenon from occurring.

It is true to say that the causes of the sticking phenomenon are known: in most cases the cause is a lack of lubrication for the working faces. Thus, the first idea which springs to mind in order to remedy such sticking is to use a relatively high lubricant flow rate. However, besides the unnecessary expense that causes, such a flow rate may be found to be excessive for certain speeds of rotation of the rolls and may be harmful to the heat exchanges between the working face and the metal, which will give rise to inadequate cooling of the strip, thus requiring the speed of the machine to be reduced. To avoid that excess, it is possible to envisage experimentally establishing a relationship giving the optimum lubricant flow rate to be used in dependence on speed. However that relationship cannot take account of certain fluctuations in operation of the machine which are due for example to the nature of the metal being cast or the quality of the lubricant, or the fact that at high speed the lubricant flow rate becomes relatively critical and it is easy to go from an excess to an insufficiency.

It is for that reason that in the course of previous research, the applicants had been led to conclude that direct monitoring of the flow rate did not make it possible to remedy the problems involved with the sticking phenomenon and that consequently it was necessary to use another procedure, the purpose of which was to reveal the preliminary warning signs in regard to sticking, in order to be able to react on the lubricant flow rate sufficiently early to prevent that defect from coming to pass.

Continuing their study, the applicants had the discovered that, prior to the formation of a sticking phenomenon, there first occurred a micro-sticking effect which is limited to a very small area on respective sides of a generatrix of one of the rolls and which is in no way harmful to the quality of the strip, then immediate unsticking followed by a fresh micro-sticking effect, and so on, until generalised sticking occurs after a rotary movement of the roll through at least one revolution. The applicants had therefore tried to detect such micro-sticking phenomena and had managed to demonstrate that in normal operation the value of the torque measured at one of the rolls normally fluctuated with a long period of the order of some tens of seconds whereas if micro-sticking phenomena occurred, that period fell to below a second. It is that invention which was the subject-matter of U.S. Pat. No. 4,501,315.

If the application of the process claimed in that patent resulted in a substantial improvement in productivity, it was however found that on the one hand the adaptation thereof to existing machines gave rise to relatively high costs while on the other hand using that process on machines with two motor-driven rolls gave rise to phenomena in respect of interference of the torque forces, which are liable to falsify the measurements of the period involved. In addition that process did not make it possible to detect excessive levels of lubricant consumption.

It is for that reason that the applicants sought for and developed a process for monitoring and regulating the lubrication of the working surface of the rolls of a continuous strip casting machine such that the process makes it possible to detect both any excess of lubricant, any insufficiency which gives rise to micro-sticking and any variation in the actual nature of the lubricant, and at the same time to remedy those anomalies by modifying the lubrication conditions by adjustment either of the flow rate and/or the speed of rotation of the rolls.

That process according to the invention is characterised by directing at least one beam of coherent light on to the lubricated working face of each of the rolls or on to each of the lubricated faces of the strip or on to the lubricated face of the roll and the lubricated face of the strip which is opposite to said roll, measuring the values of the mean strength and the frequency of the variations in the beam which is reflected by said faces, comparing said values to values which are in reference intervals and adjusting the speed of rotation of the rolls and/or the lubricant flow rate in dependence on the location of said measured values with respect to said intervals.

The applicants found that, curiously, the strength of a beam of coherent light which is reflected by the face of a roll or the cast strip varied in a similar fashion to that of the torque, that is to say that measurement oscillated with a frequency which is variable in dependence on whether micro-sticking effects are or are not present, and it could therefore serve as a way of forestalling the sticking phenomena. In addition, the applicants also noted that the mean strength of the reflected beam decreased as the amount of lubricant increased on the faces being examined, whence came the idea of using that measurement for detecting excesses of lubricant. Moreover the applicants observed that the strength also varies in dependence on the nature of the lubricant so that the measurement made makes it possible also to detect any anomaly in respect of the lubricant used.

Whether the mean strength or frequency is used, it is therefore sufficient to determine the reference intervals or ranges in which the machine operates correctly and, as soon as the measurements made move away from those intervals, to adjust the lubrication conditions, that is to say for example increase the lubrication effect when frequency measurement reveals a micro-sticking effect or in contrast reducing it when measurement of strength indicates an excess.

Because the micro-sticking phenomena or the excesses of lubricant may occur on one or other of the rolls, that is to say also on one or other of the faces of the strip, means that in total it is necessary to use at least two beams which are reflected at the faces which are not facing each other.

Generally speaking, the projection of a single beam per face is sufficient as it has been found that the sticking phenomena in particular start off in most cases all along the same generatrix of a roll. However, the process will be all the more reliable by multiplying the number of light sources.

The light is preferably projected towards the middle of the generatricoec or the width of the strip at a position which is located as close as possible to the location at which the strip issues from the machine in order to be able to detect the presence of anomalies as early as possible.

Preferably the light is projected in a direction perpendicular to the face in question in order to achieve a good level of sensitivity in regard to the measurement of reflectance. Such an assembly, however, makes it necessary to have an arrangement for deflecting the reflected beam such as a semi-transparent plate for example for detecting the reflected beam outside of the direction of emission.

Such an arrangement is generally completed by an absorber which recovers the fraction of light which is not transmitted by the plate towards the face being examined. The beam of coherent light is emitted by a source such that preferably, in association with a convergent lens or not, it forms on the face being examined a spot which is of a width of between 40 and 60 mm and a thickness of between 1 and 5 mm.

The reflected beam is detected by a photoelectric cell which supplies a current proportional to the strength of the light, the current being measured in respect of amplitude and frequency after filtration by means of an electronic device or any other suitable means. That current is then analysed by a microprocessor which controls the setting of the lubricant intake valves and the motor or motors for driving the rolls to impart a higher or lower speed thereto. It was noted that operation of the machine is subject to transient variations which have repercussions on the strength value. Therefore, to avoid untimely reactions on the part of the microprocessor, the latter has a time delay and gives the commands for adjustment of flow rate or speed when the location of the measured values with respect to the ranges or intervals indicates an anomaly for a period of five consecutive seconds.

In regard to said intervals, they were preferably selected in the following manner:

As regards strength, the applicants noted that, when taking 100 as the base value in respect of the strength of light reflected by a roll which does not have any lubricant, a value of between 40 and 80 was obtained for a correctly lubricated roll, more precisely between 50 and 70. The reference interval is therefore formed by the values which are between those limits so that if the measured strength is higher than 80, that means that there is inadequate lubrication and the lubricant flow rate must therefore be increased or the speed of the machine must be reduced, while maintaining the flow rate constant, or those two adjustments must be effected simultaneously. In contrast, if the measured strength of the light falls below 40, that means that there is an excess of lubricant and the adjustments must be in the opposite direction to those just described above.

It should be noted that the strength value considered is the mean value measured during the period of five consecutive seconds which has just elapsed.

Having thus modified the operating conditions of the machine, either the lubrication anomalies persist, in which case a fresh change in speed and/or a fresh change in lubricant flow rate is effected, or in contract the lubrication anomalies disappear and then, at the end of a given period of stability of the order of one to a few minutes, it is possible to increase the speed of the machine so as to try to attain the maximum possible speed.

That therefore provides a way of monitoring the lubrication which makes it possible to detect any abrupt variation due to a change in flow rate or a variation in the lubricant itself, and to react in consequence. However, given the critical nature of the flow rate at a high speed, that procedure is inadequate for detecting micro-sticking phenomena. Accordingly, the frequencies of the variations in the reflected strength of the light must be measured. In that area, the applicant noted that in normal operation, the strength of the light varied at a frequency which is either very small and lower than 0.5 Hertz, or greater and higher than 5 Hertz. In contrast, as soon as micro-sticking occurs, that frequency is between those two values; it is that which constitutes the reference interval which, to permit a higher degree of flexibility in operation of the machine, can be reduced to the values 0.8–1.3 Hertz.

Thus, as soon as the measured frequency remains within that interval for a period of five seconds, the microprocessor acts to increase the degree of lubrication, as set forth above, that is to say by increasing the lubricant flow rate and/or by reducing the speed. As for the strength of the light, the adjustments are repeated every five seconds as long as operation of the machine is abnormal. As soon as proper operation has been re-established, from one to several minutes is allowed to pass in order to be sure that the machine is operating in a stable fashion and then the speed of the machine is increased again to try to attain the highest possible speed. The reduction or increase of the speed of the machine may be effected progressively or in steps of given durations.

Thus, the speed of the machine may be reduced during periods of time which are less than five minutes, by an amount lower than 15% of the value of the speed at the immediately preceding moment. Likewise it can be increased during periods of time which are less than five minutes, by an amount lower than 10% of its value at an immediately preceding moment.

As regards the lubricant, the lubricant flow rate may be increased or reduced by 5 to 15% of the value of the lubricant flow rate at a previous moment.

The invention will be better appreciated by reference to the accompanying single FIGURE showing a type of machine for casting between rolls and on which can be seen a feed nozzle 1 by way of which the liquid metal is introduced between the two rolls 2 and 2' whose trunnions 3 and 4 are supported by the plummer blocks 5 and 6 which are fixed with respect to the column 7. The two rolls have their surface lubricated by means of distribution assemblies 8 and 8' supplied with lubricant by means of the valves 9 and 9'. After cooling and rolling the metal issues from the machine in the form of a strip 10 which is coiled at 11.

The rolls are driven with a rotary movement in opposite directions by means of a motor 12.

According to the invention, a beam of coherent light or a laser beam 13 which is emitted by a source 14 is directed on to the roll 2. The beam is reflected in part by a following semi-transparent plate 18 towards a light trap 19 while the other part is transmitted towards the roll and is reflected thereby. The reflected beam is deflected by 15 along the path indicated at 16 towards the photoelectric cell 17. The electric current 20 produced by the cell 17 is transmitted to the microprocessor 21 which at 22 controls the speed of the motor 12 by varying the feed voltage thereof as well as the supply of lubricant to the distribution assemblies 8 and 8' by controlling the valves 9 and 9'.

For reasons of simplicity in the drawing, the drawing does not show the second beam which could be directed for example towards the face of the roll 2'. Likewise the beam 13 should preferably strike the roll 2 on the opposite side to that illustrated.

The invention may be illustrated by means of the following example of use thereof: an aluminium alloy identified by the reference 1235 in accordance with the standards of the Aluminium Association, that is to say being of the following composition in percent by weight: Si+Fe=0.65; Cu=0.05; Mn-0.05; Mg=0.05; Zn=0.10; V=0.05; Ti=0.06; and the balance Al, was cast in the form of a strip of a thickness of 8 mm in a machine of the type PECHINEY JUMBO 3C. Two laser beam sources of a unitary power of 2 W emitting a beam 50 mm in width and 3 mm in thickness were disposed on the discharge side of the machine so that each of the beams emitted in propagated in a horizontal plane passing through the axis of each of the rolls and in a direction perpendicularto said axis and intercepting some at its middle Two semi-transparent plates each intercepted the beam reflected by each of the rolls and directed it towards a photoelectric cell. The strengths of the currents emitted by each of the cells were measured and filtered electrically in respect of frequency and the signals are passed to a microprocessor of such a design that, in dependence on the received values of strength and frequency, it can control both an increase or a reduction in the speed of the machine and/or the lubricant flow rate in accordance with a predetermined rate and a predetermined programming in respect of time.

Initially the machine operated at a speed of 1.3 m/minute and the lubricant flow rate was 10 l/h. The measured strength was equal to 50% of the strength reflected by the rolls prior to lubrication thereof and the frequency was 0.3 Hertz. After three minutes, the speed was increased by 0.05 m/minute, and that operation was repeated three times. Upon the third increase in speed, it was found after one minute that the frequency of the beam reflected by the upper roll changed in two minutes from 0.3 Hertz to 1 Hertz. The microprocessor then reduced the speed of the machine by 0.05 m/minute and raised the lubricant flow rate to 11 l/h. After a few seconds, the frequency had fallen again to 0.3 Hertz. A number of variations of that kind were observed, to which the microprocessor responded by adjustment of the values in respect of the speeds of the machine and the lubricant flow rate, which made it possible to avoid sticking and excesses of lubricant, while optimising the speed of the machine.

I claim:

1. A process for monitoring and regulating lubrication of a working face for rotary rolls of continuous strip casting machine, said process comprising the steps of:

directing at least one beam of coherent light on to at least one of the following (a) a lubricated working face of each of the rolls, (b) each lubricated face of a strip, and (c) a lubricated face of a roll and a lubricated face of a strip opposite to said roll;

measuring values representing mean strength and mean frequency of variations of said at least one beam being reflected by said lubricated faces;

comparing said measured values to values determined during reference intervals; and adjusting at least one of the following, based on the step of comparing said measured values to said values determined during the reference intervals, (a) the speed of rotation of said rolls, and (b) the lubricated flow rate.

2. A process according to claim 1, including the step of direction said at least one beam to perpendicularly strike said face.

3. A process according to claim 1, including the step of forming with said at least one beam a spot on said face having a width between 40 and 60 mm and a height between 1 and 5 mm.

4. A process according to claim 1, wherein said step of directing includes positioning said at least one beam to a point on said roll which is as close as possible to a discharge plane of the casting machine.

5. A process according to claim 1, wherein said step of adjusting includes indicating when a location of said measured value with respect to the reference interval is an anomaly for five consecutive seconds.

6. A process according to claim 1, wherein said reference interval includes a strength reference interval having values corresponding to 40–80% of the strength of light reflected by a non-lubricated face.

7. A process according to claim 6, wherein said values of the strength reference interval are between 50 and 70% of the light reflected by a non-lubricated face.

8. A process according to claim 6, wherein said step of adjusting includes at least one of the following steps when the mean value of the strength of light is lower than the reference interval, (a) reducing the lubricated flow rate, and (b) increasing the speed of rotation.

9. A process according to claim 6, wherein said step of adjusting includes at least one of the following steps when said means value of the strength of the light is higher than the reference interval, (a) increasing the lubricated flow rate, and (b) decreasing the speed of rotation.

10. A process according to claim 6, including comparing said means frequency of variations to a frequency reference interval between 0.5 and 5.0 Hertz.

11. A process according to claim 10, wherein said frequency reference interval is between 0.8 and 1.3 Hertz.

12. A process according to claim 6, wherein said step of adjusting includes at least one of the following steps when said mean frequency of variation value is within said reference interval, (a) reducing the speed of rotation, and (b) increasing the flow rate.

* * * * *

UNITED STATES PATENT AND TRADEMARK OFFICE

CERTIFICATE OF CORRECTION

PATENT NO. : 4,892,133

DATED : January 9, 1990

INVENTOR(S) : Philippe Solignac

It is certified that error appears in the above-identified patent and that said Letters Patent is hereby corrected as shown below:

On the title page:

Date of the Patent should be Jan. 9, 1990

Signed and Sealed this

First Day of January, 1991

*Attest:*

HARRY F. MANBECK, JR.

*Attesting Officer*

*Commissioner of Patents and Trademarks*